United States Patent [19]

Tamura et al.

[11] Patent Number: 4,997,350

[45] Date of Patent: Mar. 5, 1991

[54] SCROLL FLUID MACHINE WITH BEARING LUBRICATION

[75] Inventors: Takahiro Tamura, Shimizu; Kazuo Sakurai, Shizuoka, both of Japan

[73] Assignee: Hitachi, Ltd., Tokyo, Japan

[21] Appl. No.: 306,401

[22] Filed: Feb. 6, 1989

[30] Foreign Application Priority Data

Feb. 19, 1988 [JP] Japan ..... 63-35255

[51] Int. Cl.[5] ..... F04C 18/04; F04C 29/02

[52] U.S. Cl. ..... 418/55.6; 418/88; 418/94

[58] Field of Search ..... 418/55 D, 55 E, 57, 418/88, 94; 184/6.16, 6.18

[56] References Cited

U.S. PATENT DOCUMENTS 4,462,772 7/1984 Hazaki et al. ..... 418/55 E
4,551,082 11/1985 Hazaki et al. ..... 418/55 E
4,749,344 6/1988 Tomita et al. ..... 418/55 E

FOREIGN PATENT DOCUMENTS 58-176489 10/1983 Japan ..... 418/55 D
61-212689 9/1986 Japan ..... 418/55 E

*Primary Examiner*—John J. Vrablik

*Attorney, Agent, or Firm*—Antonelli, Terry, Stout & Kraus

[57] ABSTRACT

A compressor unit composed of a fixed scroll and an orbiting scroll which are engaged with each other, and a variable speed motor are disposed in a hermetic chamber. A first bearing is provided in an engagement portion between a crankshaft and the orbiting scroll in an intermediate pressure chamber provided on a back surface of the orbiting scroll for applying thereto an intermediate pressure between a discharge pressure and a suction pressure. The crankshaft is supported by a second bearing provided close to the orbiting scroll and a third bearing provided close to the motor. The first, second and third bearings are lubricated by force of a differential pressure between the discharge pressure and the intermediate pressure through an oil passage. The oil passage is in communication at one end thereof with the lubricant oil on which the discharge pressure is applied, and opens at the other end thereof into the intermediate pressure chamber. Thus, a wear and a sticking of the bearings are prevented even in a low speed region and a high speed region where it is impossible to supply oil with a conventional centrifugal pump.

6 Claims, 6 Drawing Sheets

SCROLL FLUID MACHINE WITH BEARING LUBRICATION

BACKGROUND OF THE INVENTION

The present invention relates to a scroll compressor whose rotational speed is controlled in a wide range from a low speed region to a high speed region, and, more particularly, to an oil supply system for supplying oil to bearings for supporting a crankshaft of the scroll compressor.

In a scroll compressor, a fixed scroll member with a spiral wrap and an orbiting scroll member with a like spiral wrap are engaged with each other and there is a crankshaft for make an orbiting motion of the orbiting scroll member relative to the fixed scroll in order to compress and discharge a fluid. A structure for supporting the crankshaft and an oil supply system for the support structure are shown, for example, in U.S. Pat. No. 4,551,082 in which the crankshaft is supported by a first sliding or plane bearing provided between a crank portion of the crankshaft and the orbiting scroll, a second sliding or ball and roller bearing provided between a shaft portion of the crankshaft and a frame, and a third sliding bearing. According to this system, the oil supply to the bearings is performed such that a centrifugal force is applied to lubricant oil by an eccentric oil path formed through the crankshaft, so as to supply the lubricant to the third bearing The lubricant is supplied to the second bearing by force of, in addition to the centrifugal force generated by the rotation of the crankshaft, a differential pressure between a discharge pressure and a pressure which is intermediate between the discharge pressure and a suction pressure and is applied to the back surface of the orbiting scroll member.

Also, another oil supply method for supplying lubricant to the bearings is disclosed in U.S. Pat. No. 4,462,772 in which the oil supply to the first and second bearings is performed by the differential pressure between the discharge pressure and the intermediate pressure, and the oil supply to the third bearing is performed through a branched pipe by utilizing the action of the centrifugal force of the crankshaft.

In the above-described prior art, the oil supply amount for the respective bearings is determined on the assumption that the scroll compressor be used under a rated condition at a constant rotational speed. On the other hand, there are recent demands that a scroll compressor be operated over a wide range from a low speed to a high speed responsive to the load condition of a refrigeration cycle in which the scroll compressor is incorporated. If the rotational speed of the conventional scroll compressor described above is controlled on such operation condition, the centrifugal force for oil supply is reduced, in particular, in a low speed region. It would be impossible, therefore, to keep a sufficient oil feed, which would lead to a damage of the bearings.

Additionally, since the oil supply by force of the differential pressure as described above is effected in the midway of the second bearing, the space between the second bearing and the third bearing has to be kept under the discharge pressure. It is therefore necessary to provide a spiral groove or a discharge port for discharging the lubricant. This would need large machining work.

SUMMARY OF THE INVENTION

A primary object of the invention is to provide a scroll fluid machine which has an oil supply unit for preventing a wear and a sticking of bearings while keeping a sufficient amount of oil supply even in a low speed operation when the scroll compressor is controlled in rotational speed by an inverter.

A second object of the invention is to provide a scroll fluid machine which has an oil supply system capable of being made with less manufacturing work at low cost.

A third object of the invention is to provide a scroll fluid machine which has an oil supply system capable of effecting bearings.

The primary object is attained by providing a scroll fluid machine having a bearing structure wherein oil supply to all supporting bearing for a crankshaft is performed by force of differential pressure between a discharge pressure and an intermediate pressure.

The second object is attained by providing a scroll fluid machine having a bearing structure wherein a ball and roller bearing is provided on a frame close to the crank portion of a crankshaft and a sliding bearing to which lubricant oil is supplied by force of a differential pressure is provided in a lower end of the frame.

The third object is performed by providing a scroll fluid machine having a mechanical oil discharge system or an oil supply passage whose flow path resistance is set to permit lubricant flowing at a sufficient flow rate even in the most severe lubrication condition in a given rotational speed range.

DESCRIPTION OF THE PREFERRED EMBODIMENTS

Figure 1:
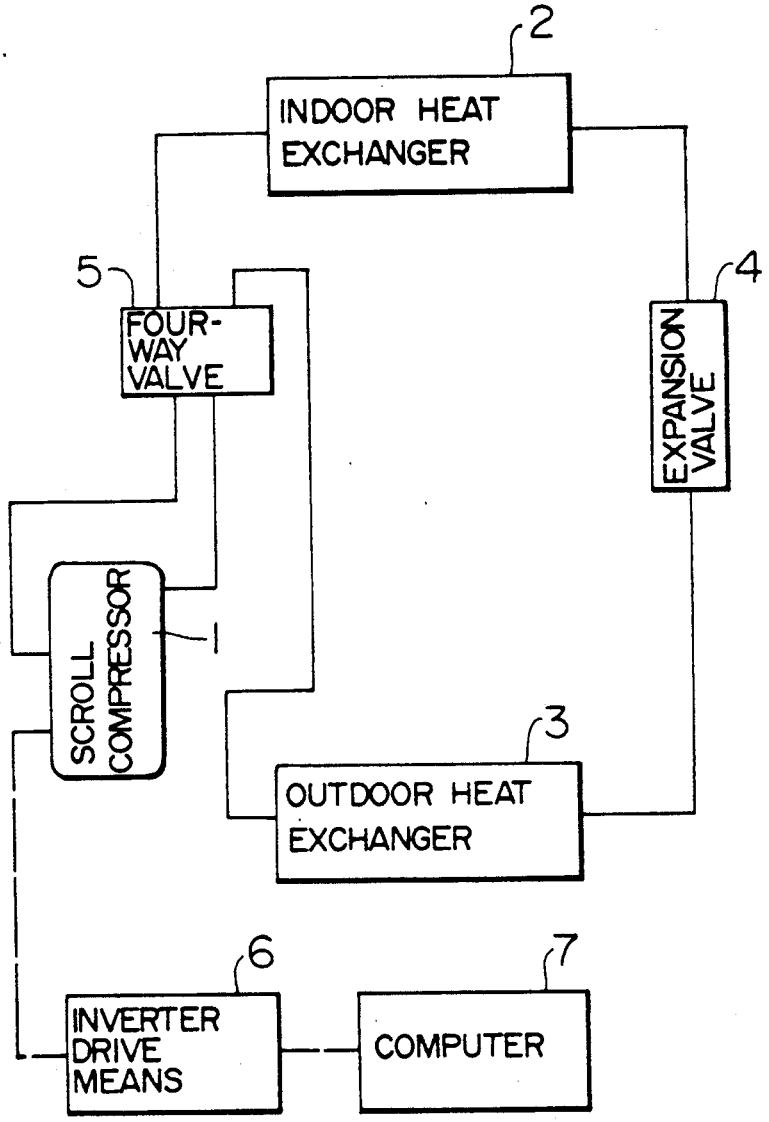
FIG. 1 is a view showing a cycle for an airconditioner including an inverter.

An embodiment of the invention will now be described with reference to FIGS. 1 to 3. FIG. 1 shows the cycle of a heat pump air conditioner that is adapted to be driven by an invertor type drive device 6. This cycle is composed of a scroll compressor 1, an indoor heat exchanger 2, an outdoor heat exchanger 3, an expansion valve 4, a four-way valve 5, the inverter drive device 6 and a computer 7. During a heating operation, coolant gas of high pressure and temperature discharged from the scroll compressor 1 is condensed and liquefied in the heat exchanger 2, and thereafter throttled by the expansion valve 4 to be of low pressure and temperature. Then, the coolant is evaporated in the heat exchanger 3 and is returned back to the intake side of the scroll compressor 1. On the other hand, during a cooling operation, the flow path of the cycle is switched over by the four-way valve 5 so that the coolant gas flows in the opposite direction to that of the heating operation. The coolant is condensed in the heat exchanger 3 and evaporated in the heat exchanger 2. A DC brushless motor is used as a drive means for the scroll compressor 1, so that the operation of the compressor is varied in speed from as low as about 30 Hz to as high as about 120 Hz responsively to a speed command from the computer 7 in accordance with a load condition of the heating or the cooling operation.

Figure 2:
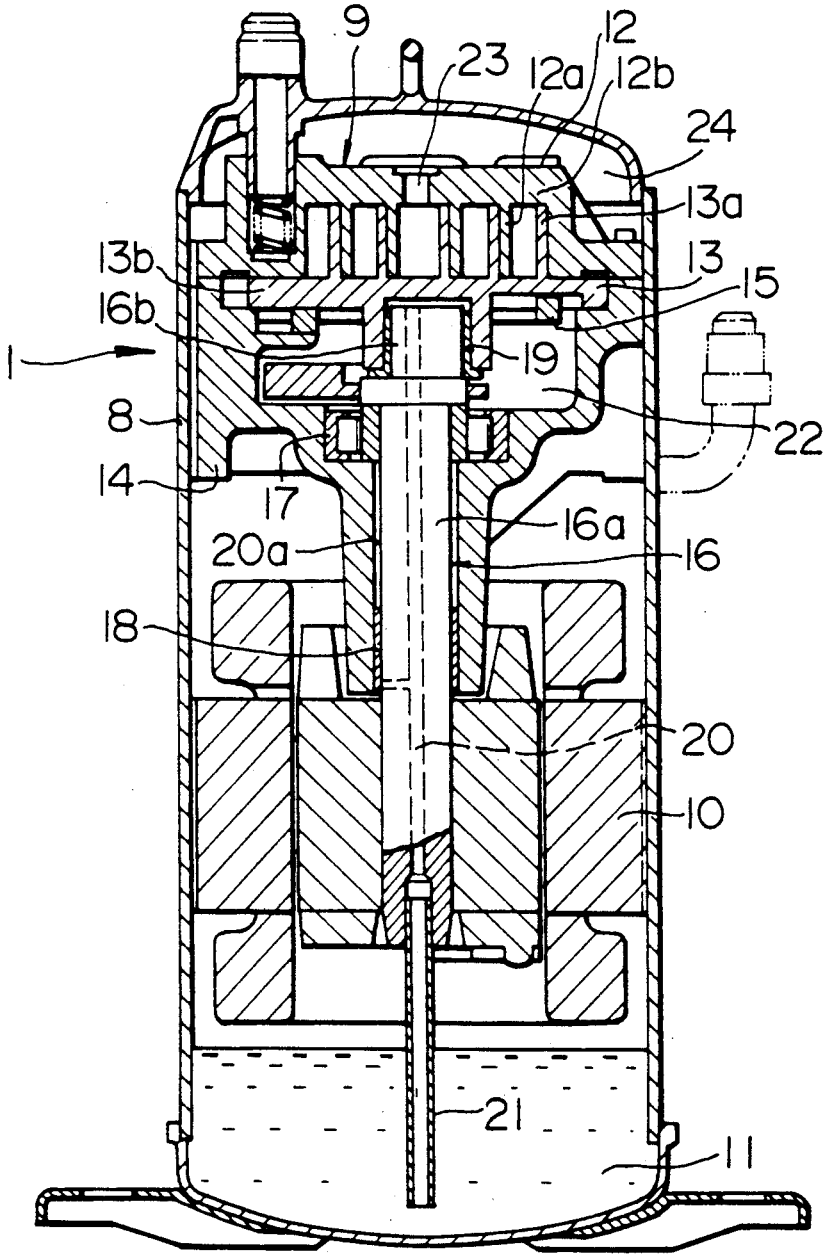
FIG. 2 is a longitudinal sectional view showing the structure of a vertical and hermetic type scroll compressor in accordance one embodiment of the invention.

In FIG. 2, a compressor section 9 is arranged on an upper side within a hermetic container 8, and an electric drive means such as a DC brushless motor 10 is arranged on a lower side within the container. An oil reservoir 11 for lubricant is formed in a bottom portion of the hermetic container 8. The compressor section 9 includes a fixed scroll 12 which has a spiral wrap 12*a* mounted on an end plate 12*b*, an orbiting scroll 13 having likewise a spiral wrap 13*a* on an end plate 13*b*, and a frame 14 coupled in unison with the fixed scroll 2 and supporting the orbiting scroll 13. The fixed scroll 12 and the orbiting scroll 13 ar engaged with their spiral wraps meshed each other.

An oldham mechanism 15 is provided between the orbiting scroll 13 and the frame 14 for preventing the orbiting scroll 13 from rotating about its own axis. The motor 10 is mounted by means of press-fit into the closed container 8, and is adapted to perform an orbiting motion of the orbiting scroll 13 through a crankshaft 16. A shaft portion 16*a* of the crankshaft 16 is supported by a second bearing 17 and a third bearing 18 both of which are mounted on the frame 14. A crank portion 16*b* of the crank shaft 16 is engaged with a first bearing 19 mounted on a back surface of the orbiting scroll 13. Incidentally, these bearings may be supported indirectly by the frame 14.

Through the crankshaft 16, there is formed an oil supply passage 20 for introducing lubricant oil to the second bearing 17, the third bearing 18 and the first bearing 19 along the axis of the shaft portion 16*a* of the crankshaft 16. Further, at an axial end of the shaft portion 16*a* adjacent to the motor 10, there is provided an oil feeding device 21 for suctioning and feeding the lubricant oil from the oil reservoir 11 into the above-described oil supply passage 20.

In the compressor section 9, when the orbiting scroll 13 is driven through the crankshaft 16 by the motor 10 to make an orbiting motion, spaces (compression chambers) defined between the orbiting scroll 13 and the fixed scroll 12 are gradually decreased in volume as they move toward the center of the scrolls, thereby suctioning coolant gas into the spaces and compressing the same. The thus compressed coolant gas is discharged from a discharge port 23, which port is formed through the end plate 12*b* of the fixed scroll 12 at a central position thereof, to an upper space 24 within the hermetic container.

In the hermetic container, further, an intermediate pressure chamber 22 into which a part of the gas that is in the midway of the compression stroke is defined on the back or lower side of the orbiting scroll 13. The pressure of the intermediate pressure chamber 22 is kept at an intermediate level between a suction pressure and a discharge pressure of the coolant gas.

Figure 3:
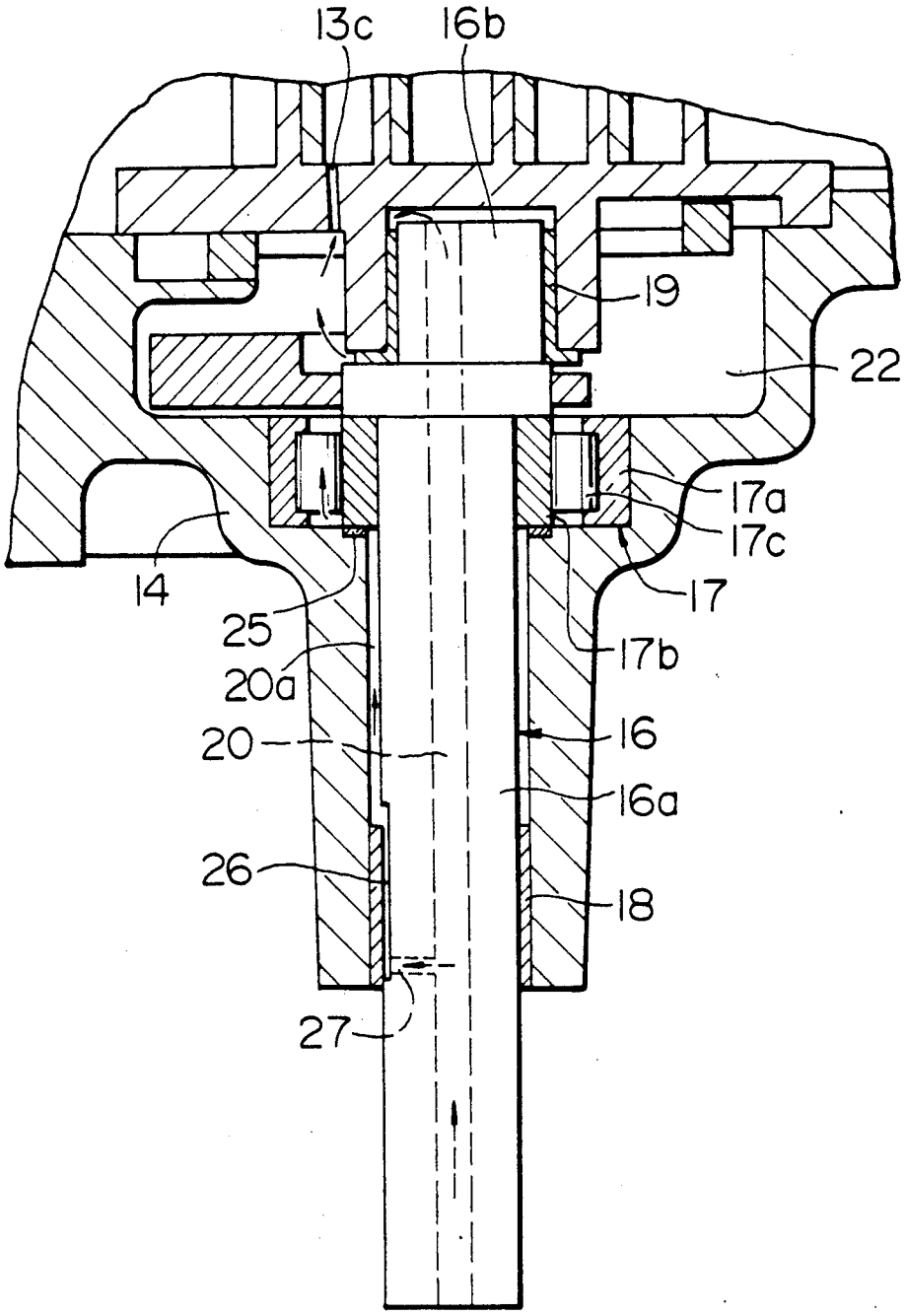
FIG. 3 is an enlarged sectional view of the bearing portion shown in FIG. 2.

FIG. 3 is an enlarged view for explanation of the bearing structure in more detail. The second bearing 17 is a roller bearing composed of an outer race 17, an inner race 17*b*, rollers 17*c* and other elements. A thrust bearing 25 is provided at a lower end of the inner race 17 for supporting the crankshaft 16. Grooves are formed in a surface of the thrust bearing 25. Oil supply to the first bearing 19 is performed by force of a differential pressure between the discharge pressure Pd and the intermediate pressure Pm.

An axial groove 26 is formed in a surface of the crankshaft 16 that slides on the third bearing 18. An oil hole 27 for communication with the oil supply passage 20 is formed in a lower end portion of the axial groove 26 which extends downwardly to the vicinity of the lower end of the third bearing 18.

On the other hand, the upper end of the axial groove 26 is in communication with a space defined between the frame 14 and the crankshaft 16 above the third bearing 18. Therefore, the intermediate pressure space 20*a* is provided on the upper end side of the third bearing 18, i.e., between the second bearing 17 and the third bearing 18. The intermediate pressure space 20*a* is kept at a pressure Pm1 that is slightly higher than the pressure in the intermediate pressure chamber. The pressure at the lower end of the third bearing is kept at the discharge pressure Pd. The lubricant oil flows by force of the differential pressure between the discharge pressure Pd and the intermediate pressure Pm from the oil feeding device 21 through the oil supply passage 20. Part of the lubricant oil flows through the oil supply port 27 into the axial groove 26 to lubricate the third bearing 18. Thereafter, this lubricant oil flows through the thrust bearing 25 to lubricate the same by force of a differential pressure ($Pm2 < Pm1$) between a pressure Pm2 in the roller portion of the second bearing and the pressure Pm1 in the intermediate pressure space 20*a*, and then flows through the second bearing 17 to lubricate the same by a differential pressure between the pressure Pm2 and the pressure Pm ($Pm2 > Pm$). This part of the lubricant oil flows lastly in the intermediate pressure chamber 22. The other part of the lubricant oil is used to lubricate the first bearing 19 and then flows into the intermediate pressure chamber 22. That is, the entry portions for lubricant oil of the respective bearings and the intermediate pressure chamber 22 are in communication with each other, so that the lubricant oil used to lubricate the respective bearings may be all introduced into the intermediate pressure chamber. The lubricant oil that has entered the intermediate pressure chamber 22 flows through an intermediate hole 13*c* which is formed through the end plate of the orbiting scroll, into the compression chambers. The lubricant oil is then discharged from the discharge port 23 to the upper space 24 of the hermetic container 8 in a state of a mixture with the coolant gas. As described above, the lubricant oil that has been used t lubricate the first bearing 19 and the third bearing 18 is introduced into the intermediate chamber 22. Incidentally, any groove or the like for retaining the oil is not provided in the third bearing 18.

In the heating or the cooling operation of the air conditioner, when the load changes, a speed command signal of the computer 7 is fed to the inverter drive device 6. The electric motor 20 is so constructed that its rotational speed is changed in the range of about 30 Hz to 120 Hz in response to the speed command signal. According to the present invention, as described above, since the oil supply to the second bearing 17, the third bearing 18, the thrust bearing 25 and the first bearing 19 is all performed by utilizing the differential pressure between the discharge pressure and the intermediate pressure, when once the flow path resistances of the oil supply passage and the bearings are determined appropriately, it is possible to obtain a substantially constant flow rate of oil corresponding to the flow path resistances irrespective of the rotational speed of the scroll compressor 1. This flow path resistance is determined so that a sufficient thickness of oil film may be kept on the sliding surface of each bearing even under the most severe condition of lubrication within the range of the given rotational speeds, and that the flow rate of lubricant may be set to sufficiently suppress any increase in temperature of the bearings. Since the flow path resistances of the first bearing 19, the third bearing 18 and the thrust bearing 25 are determined in the above-described manner, an oil supply amount to the bearings can be kept at a satisfactory level even in the low speed operational region of the compressor in which some problems have been raised in the conventional system. Thus, the invention makes it possible to enjoy the advantage that the wear and sticking of the bearings may be avoided. Also, because the flow path resistances are set so that the sufficient flow rate of lubricant may be kept under the most severe condition within the given rotational speed range, it is possible to prevent any wear and sticking of the bearings over the entire operational region. Further, since the structure for supporting the shaft portion 16*a* of the crankshaft 16 is composed of the second bearing 17 and the third bearing 18, and these bearings are lubricated only by force of the differential pressure, it is unnecessary to form any spiral groove for discharging the oil in the third bearing or a hole for discharging the oil in the frame and the bearings for supporting the crankshaft can be reduced in number. It is therefore possible to provide the bearing structure of the compressor at a low cost.

Figure 4:
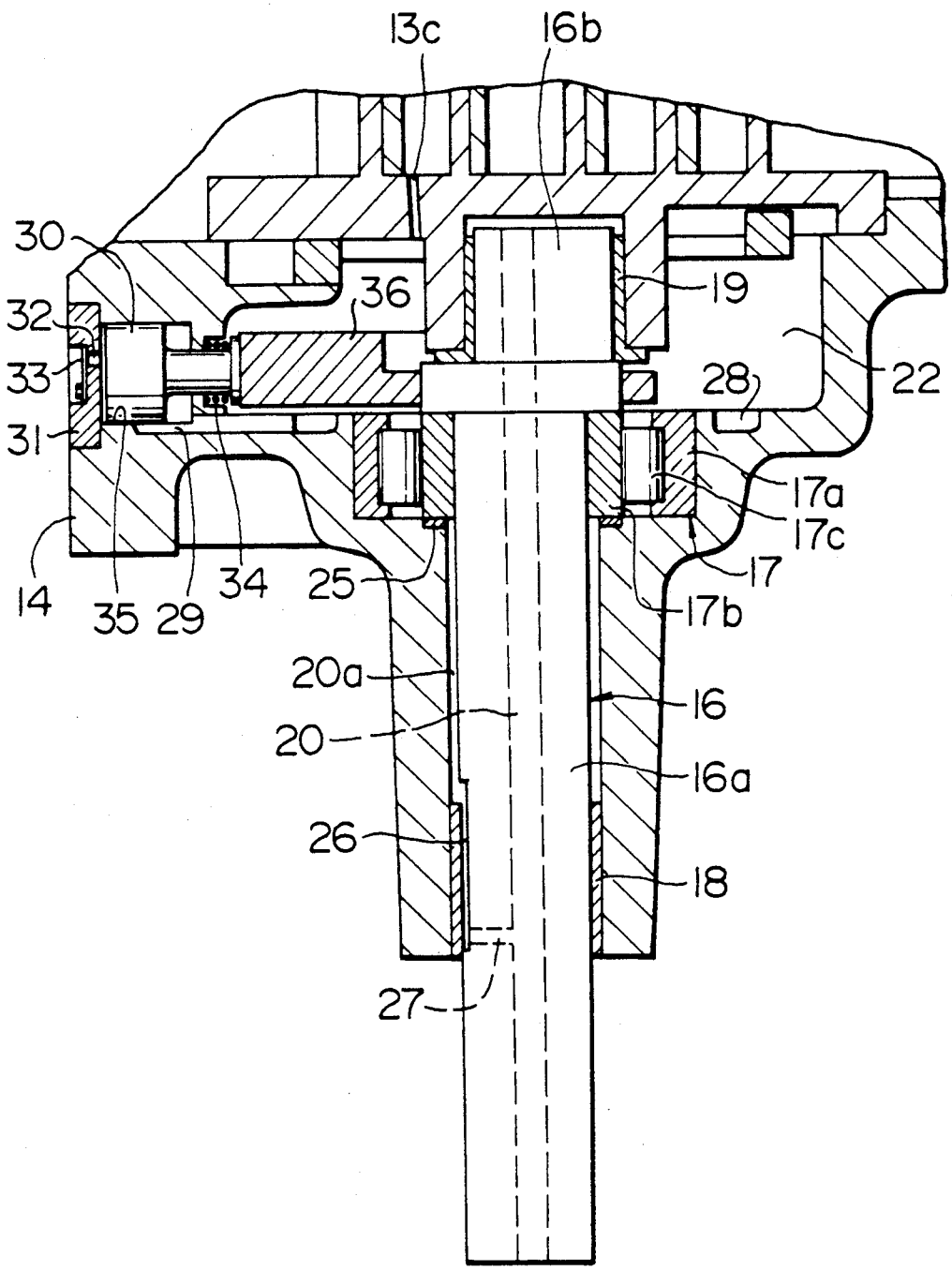
FIG. 4 is an enlarged sectional view showing the bearing portion of a scroll compressor in accordance with another embodiment of the invention.

In the embodiment of FIG. 4, the lubricant oil that has been introduced into the intermediate pressure chamber after the lubrication of the respective bearings is to be discharged without passing through the intermediate hole 13*c*.

In a bottom portion of the frame 14, there is formed an annular groove 28 for storing the lubricant oil that has entered into the intermediate chamber 22. Further, in this frame 14, there are provided a cylindrical hole, a piston 30 for reciprocation within the cylindrical hole by utilizing the motion of a balance weight 36, a groove 29 for sucking the lubricant oil, a cylinder head 31, a discharge port 32 formed in the cylinder head 31, discharge valve 33 and a spring 34 for returning the piston 30 so as to form an oil discharge pump. The other structure is the same as that of the embodiment shown in FIG. 3. As described above in connection with the first embodiment, the lubricant oil that has been used to lubricate the respective bearings is introduced into the intermediate pressure chamber 22 owing to the differential pressure between the discharge pressure and the intermediate pressure. The thus introduced lubricant oil collects in the annular groove 28 in the bottom of the intermediate pressure chamber. The balance weight 36 is rotated together with the crankshaft 16. When the balance weight 36 is brought to the pump side as shown in FIG. 4, it causes the piston 30 to move toward the cylinder head 31 for discharge of the lubricant oil kept in the cylinder into the interior of the hermetic container 8, so that the lubricant oil may return back to the oil reservoir 11 in the bottom of the hermetic container 8. As the balance weight 36 is rotated to the opposite side, the piston 30 is pushed by the spring 34 to move to the balance weight side, so that the lubricant oil in the annular groove 28 is drawn through the groove 29 into the cylinder 35. This operation is repeated, and the lubricant oil introduced into the intermediate chamber 22 is discharged without passing through the intermediate hole 13c. Although in this embodiment the motion of the balance weight is utilized to drive the pump, it is possible to alternatively use a rotational motion type pump or a reciprocation type pump which utilizes the orbiting motion of the orbiting scroll. According to this embodiment of the invention, in addition to the advantages of the embodiment shown in FIGS. 1 to 3, there is brought an advantage that the lubricant oil in the intermediate pressure chamber does not reach a level at which the balance weight 36 is rotated, so that the oil is not agitated by the balance weight 36. This contributes to a reduction of the rotational power of the compressor.

Figure 5:
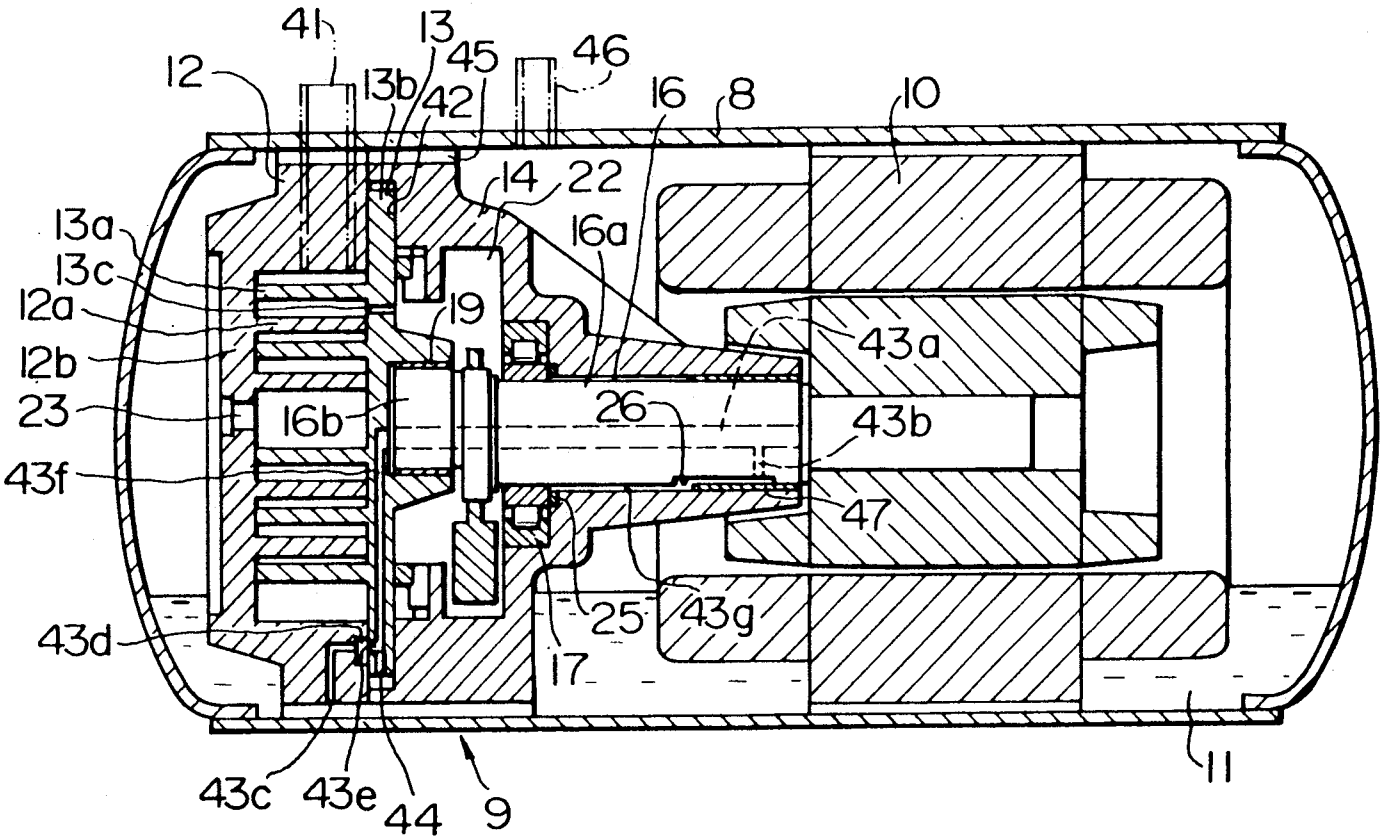
FIG. 5 is a longitudinal sectional view showing the structure of a horizontal and hermetic type scroll compressor in accordance with still another embodiment of the invention.

Referring to FIG. 5, a scroll compressor mechanism section 9 and an electric power generator such as a DC brushless motor 20 for driving the mechanism section 9 are disposed horizontally within a hermetic container 8. An oil reservoir 11 is formed in the lower portion of the hermetic container 8.

The scroll compressor mechanism section 9 is composed of an orbiting scroll 13, a fixed scroll 12, a drive shaft 16 formed as a crankshaft driven by the motor 10, a frame 14 and a mechanism 40 for preventing the orbiting scroll from rotating about its own axis.

The orbiting scroll 13 has a spiral wrap 13*a* mounted on an end plate 13*b*. A first bearing 19, into which a crank portion 16*a* of the drive shaft 16 is inserted, is formed in a back surface of the end plate 13*b*. A pressure lead hole 13*c* through which an intermediate chamber 22 and a space defined between the wrap 13*a* and an associated spiral wrap of the fixed scroll are communicated with each other is formed in the end plate 13*b*.

In the same way, the fixed scroll 12 fixedly mounted on the container 8 is also provided with a spiral wrap 12*a* on an end plate 12*b*. Further, a suction port 41 is formed in an outer periphery of the wrap and a discharge port 23 is formed in a central portion of the wrap.

In the frame 14 fixed to the container 8, there are formed a second bearing 17, a third bearing 47 and a thrust bearing 25 for supporting the drive shaft 16. Further, a seat 42 for clamping the orbiting scroll 13 in cooperation with the fixed scroll 12, and the intermediate pressure chamber 22 for imparting a suitable pressing force to the orbiting scroll 13 are provided.

The orbiting scroll 13 and the fixed scroll 12 are engaged with their wraps 12*a* and 13*a* facing inwardly to each other. The orbiting scroll 13 is clamped by the fixed scroll 12 and the seat 42 of the frame 14. The mechanism 40 for preventing the orbiting scroll from rotating about its own axis is interposed between the orbiting scroll and the frame 14.

The drive shaft 16 is provided with a crank portion 16*a* supported at one end thereof by the bearing 19. In the drive shaft 16, an oil supply passage 43*a* is formed in the shaft 16 along the rotational center thereof. The oil supply port 43*a* opens at one axial end thereof to the end face of the crank portion 16*a* and is in communication with the bearing 47 through an oil supply port 43*b*.

In the end plate 12*b* of the fixed scroll 12, there are formed an oil supply passage 43*c* which is in communication with the oil reservoir 11, and an oil supply port 43*d* opening at a portion of the scroll on which the end plate 13*b* of the orbiting scroll 13 slides, for communication with the oil supply passage 43*c*. On the other hand, in the end plate 13*b* of the orbiting scroll 13, there is formed a radial oil supply face of the bearing 19 and the outer periphery of the end plate 13*b*. The outer end portion of the oil supply passage 43*f* is closed by a screw 44. An oil supply port 43*e* for connecting the oil supply passage 43*f* and the oil supply port 43*d* of the fixed scroll 12 is provided to open in the sliding portion between the end plate 13*b* of the orbiting scroll and the end plate 12*b* of the fixed scroll 12.

Figure 6:
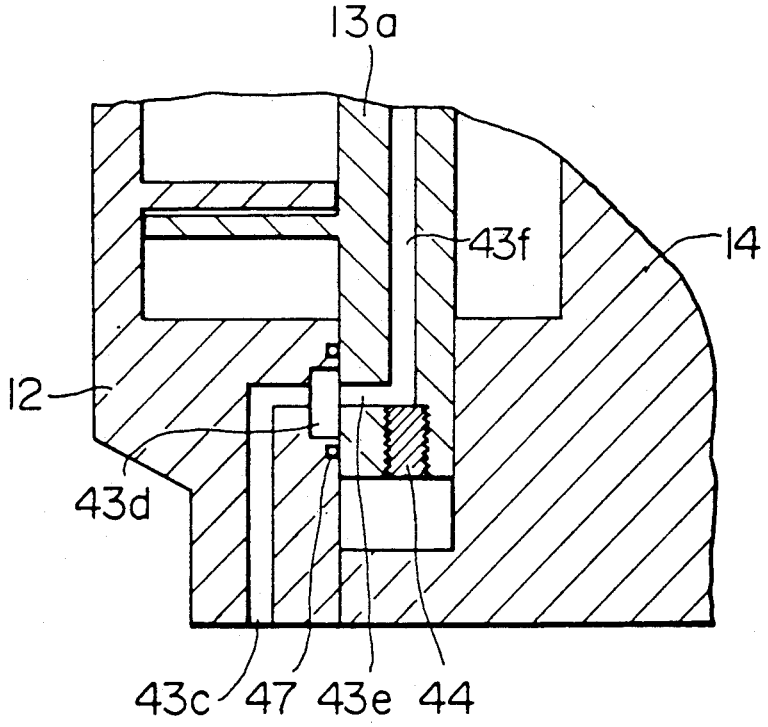
FIG. 6 is an enlarged sectional view of the oil supply portion shown in FIG. 5.

As shown in FIG. 6, as the orbiting scroll 13 makes an orbiting motion, a center of the oil supply passage 43*f* formed radially through the end plate of the orbiting scroll makes also an orbiting motion at the same radius as the crank radius of the crank portion 16*a* of the shaft 16, i.e., the radius of orbiting motion of the orbiting scroll. The sum of the radius of an opening of the oil supply port 43*e* and the radius of the oil supply port 43*d* formed in the wrap 13*a* at a position facing the opening of the port 43*e* is longer than the orbiting radius of the oil supply passage 43*f*. Thus, during the orbiting motion of the orbiting scroll 13, the oil supply port 43*e* and the oil supply port 43*d* are always in communication with each other.

The second bearing 17 is a roller bearing which is composed of an outer race, an inner race, rollers and the like. The thrust bearing is provided on a motor side end of the inner race in order to bear a thrust force acting on the crank shaft. Grooves are provided in the thrust bearing 25. An axial groove 26 is formed in a surface of the crankshaft 16 which slides on the third bearing 47, in the same manner as in the embodiment shown in FIG. 3. The axial groove 26 extends from the vicinity of a motor side end of the third bearing 47 to be in communication with a space which is defined by the frame 14 and the crankshaft 16 between the thrust bearing 25 and the third bearing 47. The axial groove 26 is in communication with, at a portion thereof close to its axial end on the motor side, the oil supply passage 43*a* which is formed through the crankshaft 16 along the centerline thereof but is blocked at an axial end thereof on the motor side.

When the drive shaft 16 is rotated by the motor 20, the orbiting scroll 13 makes an orbiting motion without rotation about its own axis owing to the action of the rotational motion of the crank portion 16*a* and the mechanism 40 for preventing the orbiting scroll from rotating about its own axis. As a result, the spaces defined by the wraps 12*a*, 13*a* and the end plates 12*b*, 13*b* of the fixed and orbiting scrolls 12, 13 are gradually decreased in volume while moving toward the center of the scrolls, thereby compressing a gas drawn therein from the suction port 41 and discharging it from the discharge port 23. The thus discharged gas flows through a passage 45 formed in the end plate 12*b* of the fixed scroll and the frame 14 to cool the motor 10. Thereafter, the gas is discharged from a discharge port 46 formed in the hermetic container. When the scrolls perform the compression stroke, a force for separating the orbiting scroll 13 from the fixed scroll 12 is produced. Therefore, in order to avoid this separation, a pressure in the intermediate pressure chamber 22 on the back or rear side of the orbiting scroll is kept at a level (intermediate pressure) lower than the discharge pressure but higher than the suction pressure by the action of the pressure lead hole 13*c*. Therefore, a space on the compressor mechanism side of the third bearing 47, or the space 43*g* between the second bearing 17 and the third bearing 47 becomes to be at a pressure level Pml slightly higher than that of the intermediate pressure chamber 22. On the other hand, the end of the third bearing 47 on the motor side is subjected to the discharge pressure Pd.

Accordingly, the end face of the second bearing 17 of the frame and that of the bearing 19 of the orbiting scroll on the intermediate pressure chamber 22 are kept under the above-described intermediate pressure. As a result, the oil in the oil reservoir 11 is introduced, by the action of the discharge pressure, up to an axial open end of the oil supply passage 43*a* through the oil supply passage 43*c* and the port 43*d* both formed in the fixed scroll and the oil supply port 43*e* and the passage 43*f* both formed in the orbiting scroll. The oil supply passage 43*a* is thus filled with the oil. The oil is supplied to the third bearing 47 through the oil supply port 43*b* by force of the differential pressure between the discharge pressure Pd and the intermediate pressure Pml. After the lubrication of the third bearing 47, the oil flows to the thrust bearing 25 to lubricate the same by force of a differential pressure (Pm1 > Pm2) between the intermediate pressure Pm1 and a pressure Pm2 in the roller portion of the second bearing, then flows into the second bearing 17 to lubricate the same owing to a differential pressure (Pm2 > Pm) between the pressure Pm2 of the roller portion and the intermediate pressure Pm of the intermediate pressure chamber, and flows lastly into the intermediate pressure chamber 22 On the other hand, the bearing 19 is lubricated by the oil which is fed through the oil supply passage 43*f* to an end of the bearing by force of the differential pressure between the discharge pressure and the intermediate pressure, and then this oil flows also into the intermediate pressure chamber 22. The lubricant that has flowed into the intermediate pressure chamber 22 is introduced into the compression chambers of the compressor through the pressure lead hole 13*c*, and is discharged, in the state of a mixture with the coolant gas, into the hermetic container 8 from a discharge port formed in the central portion of the fixed scroll 12. Then, the lubricant is collected in the oil reservoir 11.

With the above arrangement, even in the application of the invention to the horizontal type scroll compressor driven by the inverter, since the oil supply to all of the second bearing 17, the third bearing 47 and the thrust bearing 25 is effected by the differential pressure between the discharge pressure and the intermediate pressure, a sufficient amount of oil can be supplied to the respective bearings even when the operational speed of the compressor is low. It is therefore possible to prevent the occurrence of wear and sticking of the bearings. Further, as described above, the flow resistances of the respective bearings may be determined in view of the oil flow rate at which a necessary oil film thickness and cooling effect for each bearing is ensured even under the most severe lead condition within a given speed range of the compressor. By such determination of the flow resistances, the bearings can be prevented from being worn or burned over all the operation region.

In addition, the crankshaft 16 is supported by the second bearing 17 and the third bearing 47, and the oil supply to these bearings is performed by force of the differential pressure. Therefore, it is unnecessary to provide any spiral groove for discharging oil in the third bearing, or to provide a hole for discharging oil in the frame. Also, the number of the bearings can be reduced to provide a bearing system at a low cost.

Further, the oil discharge mechanism as shown in FIG. 4 may be provided on the frame 14 in the intermediate pressure chamber for discharging the oil to the oil reservoir. In this case, it is possible to reduce a loss of power due to the agitation of oil by the balance weight.

Furthermore, in case that the scroll compressor is of a horizontal type, the installation thereof is facilitated owing to the positional relation of the compressor with the heat exchangers in the air conditioner, thereby making the air conditioner compact in size.

What is claimed is:

1. A scroll fluid machine comprising: a fixed scroll; an orbiting scroll engaged with said fixed scroll; a crankshaft coupled to said orbiting scroll; a plurality of bearings for supporting said crankshaft; variable speed moor means for driving said crankshaft; a hermetic container for receiving said fixed and orbiting scrolls, said crankshaft, said bearings, and said motor means in a closed space of the container to which a discharge pressure is applied; lubricant supply means for supplying lubricant stored in said hermetic container to said plurality of bearings; and intermediate pressure chamber means for applying an intermediate pressure between the discharge pressure and a suction pressure onto a back surface of said orbiting scroll; said crankshaft being supported by a first bearing provided at a position where said orbiting scroll and said crankshaft are engaged with each other in said intermediate chamber means, a second bearing provided close to said orbiting scroll, and a third bearing provided close to said motor means; a space between said second and third bearings being in communication with said intermediate pressure chamber means to form an intermediate pressure portion; and said lubricant supply means having a first oil supply passage connected to one end thereof with the lubricant in said hermetic container and opening at an other end thereof to communicate through the first bearing with said intermediate pressure chamber means, and a second oil supply passage branched from said first oil supply passage and communicating through said third bearing with said intermediate pressure portion and further communicating through said second bearing with said intermediate pressure chamber means such that the lubricant may be supplied substantially by differential pressures only without centrifugal pumping action on the lubricant.

2. A scroll fluid machine comprising: a fixed scroll; an orbiting scroll engaged with said fixed scroll; a crankshaft coupled to said orbiting scroll; a plurality of bearings for supporting said crankshaft; variable speed motor means for driving said crankshaft; a hermetic container for receiving said fixed and orbiting scrolls, said crankshaft, said bearings, and said motor means in a closed spaced of the container to which a discharge pressure is applied; lubricant supply means for supplying lubricant stored in said hermetic container to said plurality of bearings; intermediate pressure chamber means for applying an intermediate pressure between the discharge pressure and a suction pressure onto a back surface of said orbiting scroll; said crankshaft being supported by a first bearing provided at a position where said orbiting scroll and said crankshaft are engaged with each other in said intermediate chamber means, a second bearing provided close to said orbiting scroll, and at least one third bearing provided close to said motor means; and said lubricant supply means having a first oil supply passage communicating at one end thereof with the lubricant in said hermetic container and opening at an other end thereof to communicate through the first bearing with said intermediate pressure chamber means, and a second oil supply passage branching from said first oil supply passage, said branching oil supply passage opening into an end of said third bearing close to said motor means, said opening of said second oil supply passage being in communication with said intermediate pressure chamber means through said second bearing by a cross-sectional area such that the lubricant of a necessary maximum supply flow rate may be supplied within a given range of rotational speed substantially by differential pressures only without centrifugal pumping action on the lubricant.

3. The scroll fluid machine according to claim 1, wherein said second bearing comprises a roller bearing.

4. The scroll fluid machine according to claim 1, further comprising an oil supply mechanism for delivering the oil from said intermediate pressure chamber means into said hermetic container, said oil supply mechanism being provided in a frame defining said intermediate pressure chamber means.

5. The scroll fluid machine according to claim 1, wherein said fixed scroll and said orbiting scroll are provided in an upper portion of said container and said motor means is provided in a lower portion thereof.

6. The scroll fluid machine according to claim 1, wherein said crankshaft is disposed perpendicular to a gravitational direction.

* * * * *